US007452191B2

(12) United States Patent
Tell

(10) Patent No.: US 7,452,191 B2
(45) Date of Patent: Nov. 18, 2008

(54) VACUUM PUMP AND METHOD FOR GENERATING SUB-PRESSURE

(75) Inventor: Peter Tell, Akersberga (SE)

(73) Assignee: PIAB AB, Taby (SE)

( * ) Notice: Subject to any disclaimer, the term of this patent is extended or adjusted under 35 U.S.C. 154(b) by 818 days.

(21) Appl. No.: 10/513,296

(22) PCT Filed: Apr. 29, 2003

(86) PCT No.: PCT/SE03/00679

§ 371 (c)(1),
(2), (4) Date: Nov. 3, 2004

(87) PCT Pub. No.: WO03/093678

PCT Pub. Date: Nov. 13, 2003

(65) Prior Publication Data

US 2005/0232783 A1 Oct. 20, 2005

(30) Foreign Application Priority Data

May 3, 2002 (SE) ..... 0201335

(51) Int. Cl.
*F04B 23/14* (2006.01)
*F04B 23/08* (2006.01)
*F04F 5/22* (2006.01)

(52) U.S. Cl. ..... 417/89; 417/80; 417/85; 417/87; 417/163; 417/165; 417/169; 417/170; 417/199.2

(58) Field of Classification Search ..... 417/85, 417/87, 163, 165, 168, 169, 170, 182, 199.2, 417/410.2, 410.4, 80
See application file for complete search history.

(56) References Cited

U.S. PATENT DOCUMENTS

| | | | | |
|---|---|---|---|---|
| 3,265,293 | A | 8/1966 | Schibbye | |
| 4,395,202 | A * | 7/1983 | Tell | 417/169 |
| 4,466,778 | A * | 8/1984 | Volkmann | 417/174 |
| 4,877,377 | A * | 10/1989 | Taylor | 417/89 |
| 4,880,358 | A * | 11/1989 | Lasto | 417/174 |
| 5,951,266 | A * | 9/1999 | Maruyama et al. | 417/410.4 |
| 6,004,109 | A | 12/1999 | Gebele et al. | |
| 6,171,068 | B1 * | 1/2001 | Greenberg | 417/174 |
| 6,394,760 | B1 * | 5/2002 | Tell | 417/174 |
| 6,464,262 | B1 * | 10/2002 | Tell | 285/124.5 |
| 6,682,313 | B1 * | 1/2004 | Sulmone | 417/199.2 |
| 2005/0083654 | A1 * | 4/2005 | Tsoi | 361/699 |

FOREIGN PATENT DOCUMENTS

| | | |
|---|---|---|
| EP | 1234982 A1 * | 8/2002 |
| SE | 517211 | 5/2002 |

* cited by examiner

*Primary Examiner*—Devon C Kramer
*Assistant Examiner*—Leonard J Weinstein
(74) *Attorney, Agent, or Firm*—Young & Thompson

(57) ABSTRACT

According to the invention, a vacuum pump is disclosed comprising a screw-rotor pump having a compression section (8) and an expansion section (7), and wherein a discharge (10) from the compression section communicates with at least one ejector (1) for discharge of compressed gas through the ejector, and wherein the expansion section (7) is connectable via a first valve means (5), to a drive-gas source (P) for operating the screw,-rotor pump and the ejector in parallel. Also, a method for providing sub-pressure to an industrial process is disclosed wherein at least one ejector (1) is used initially to reduce the pressure to a predetermined lower level, from where the pressure is further reduced by means of a screw-rotor pump (7, 8) that is arranged to operate through, and in parallel with the ejector.

8 Claims, 2 Drawing Sheets

VACUUM PUMP AND METHOD FOR GENERATING SUB-PRESSURE

TECHNICAL FIELD

Figure 1:
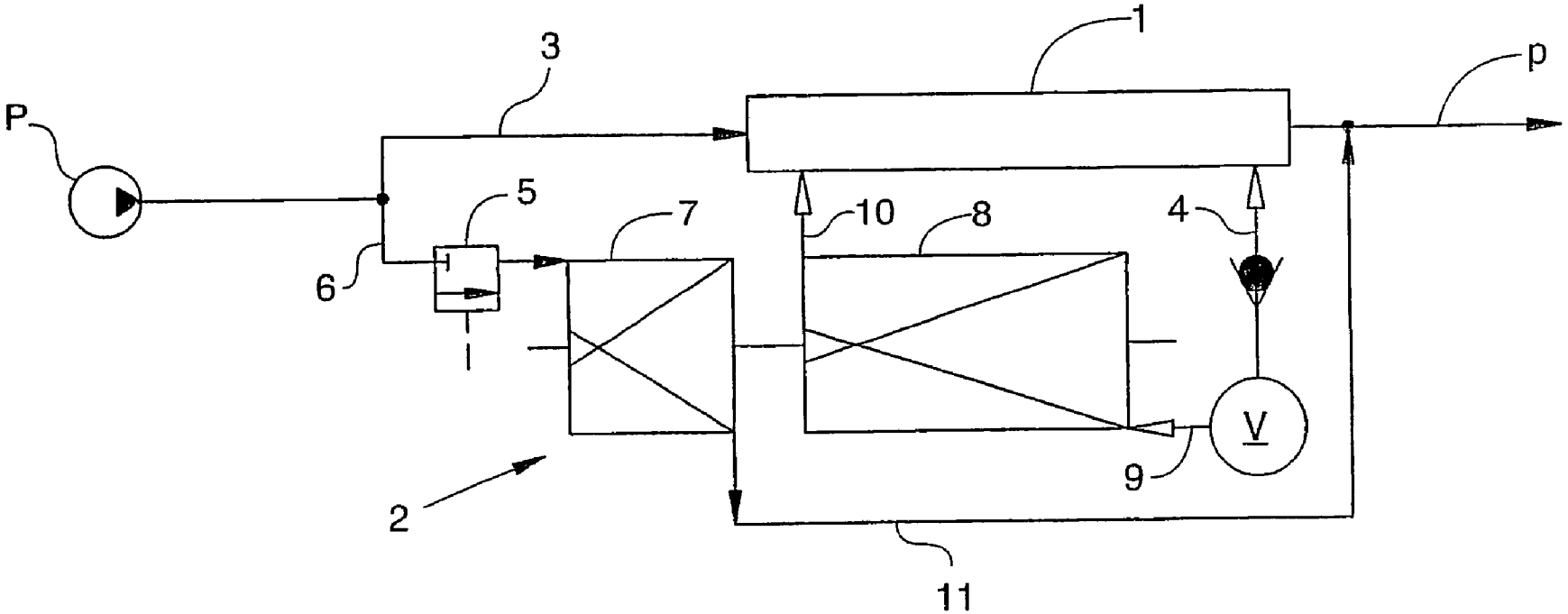

The subject invention refers to a pump for generating sub-pressure or vacuum, the pump comprising a screw-rotor type pump in integration with an ejector. In accordance herewith, the invention also refers to a method for providing sub-pressure to an industrial process.

BACKGROUND AND PRIOR ART

For example, vacuum pumps of the screw-rotor type are previously known from SE 0002129-5 (Svenska Rotor Maskiner AB). Screw-rotor pumps of that type comprises a compression section wherein intermeshing rotor bodies are rotated for compression of a gas that is drawn in between the rotating bodies. The compression section is driven by an expansion section having intermeshing rotor bodies that are caused to rotate through the expansion of a drive gas, such as compressed air, that is introduced in the expansion section.

Vacuum pumps of the ejector type, driven by compressed air for generating a sub-pressure, are previously known from SE 9800943-4 (PIAB AB), e.g. The ejector pump is driven by compressed air that is accelerated through a number of nozzles, arranged in succession. A pressure drop is generated about the jet of compressed air, between the nozzles, and used for evacuation of surrounding air that is drawn through openings in the ejector wall to be captured by the jet.

These two types of pumps have different operation characteristics. In this connection, the ejector is characterized by a fast initial effect within an upper pressure region below atmosphere, whereas the screw-rotor pump is characterized by a higher efficiency within a lower pressure region. Also, the screw-rotor pump is characterized by a considerable temperature rise in the compressed gas or air upon discharge from the compression section of the screw-rotor type pump.

Within the industries relying on vacuum operations, there is a desire to reduce the times required to evacuate a cavity, such as the volume of air that is defined under a suction cup. One method to satisfy this desire is to de-centralize the production of sub-pressure by spreading the vacuum sources to be positioned near the vacuum consumers, and thus omitting long passages for distribution of sub-pressure and reducing the total volume or air to be evacuated. However, in certain applications operated by sub-pressure, the elevated temperature in the compressed discharge air from a screw-rotor pump may obstruct a free de-centralization of vacuum sources. This applies, e.g., to the pharmaceutical and food industries, and the packing industry as well.

The present invention aims to meet the above desire and solve the problems referred to above by providing a vacuum pump comprising a screw-rotor pump in integration with an ejector, as defined in appended apparatus claim 1 and appended method claim 8.

SUMMARY OF THE INVENTION

Briefly, the invention foresees a vacuum pump comprising a screw-rotor pump having a compression section and an expansion section, wherein the discharge from the compression section communicates with at least one ejector for discharge of compressed gas through the ejector, and wherein the expansion section is connectable, via a first valve means, to a drive-gas source for operating the screw-rotor pump and the ejector in parallel.

The valve preferably is arranged to connect the screw-rotor pump to the same drive-gas source that operates the ejector, and the valve is opened for driving the screw-rotor pump in response to a sub-pressure generated by the ejector.

A second valve means may additionally be arranged to close an evacuation passage to the ejector, when said first valve means is open for driving the screw-rotor pump.

Preferably, the expansion section of the screw-rotor pump communicates with the discharge region of the ejector in order to mix the discharge gases from the ejector with drive-gas which is expanded through the screw-rotor pump.

In accordance herewith there is also foreseen a method of providing sub-pressure to an industrial process, wherein at least one ejector is used initially to reduce the pressure to a predetermined lower level, from where the pressure is further reduced by means of a screw-rotor pump that is arranged to operate through, and in parallel with the ejector.

Further specifications and advantages are defined in the subordinated claims.

DRAWINGS

Figure 2:
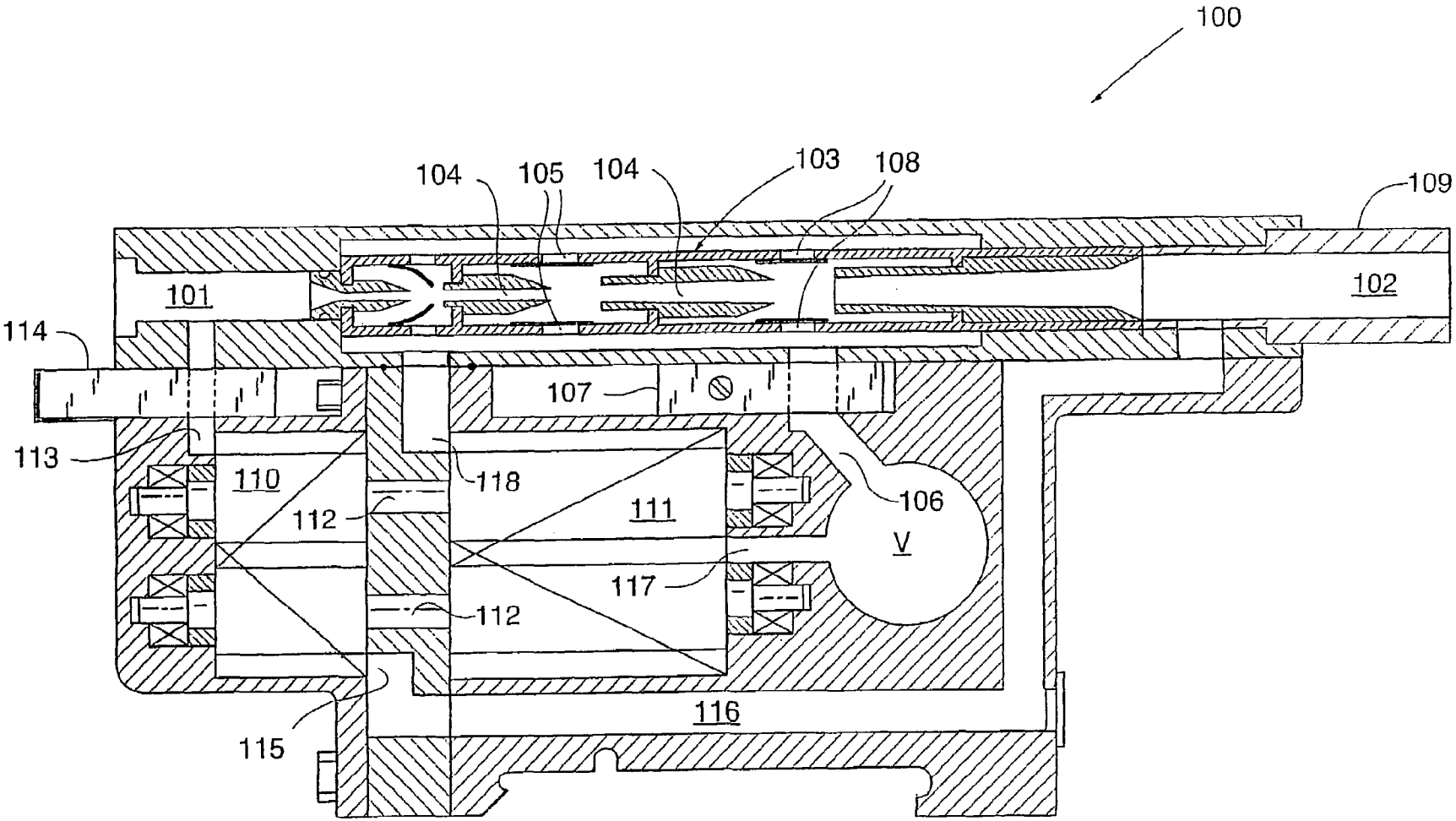

The invention is further explained below, reference being made to the accompanying drawings wherein FIG. 1 is a flow chart and a diagram showing a typical arrangement in a vacuum pump according to the invention, and FIG. 2 is an embodiment example showing the inventive arrangement of FIG. 1 being realized through the integration of a screw-rotor pump and an ejector in a pump structure.

DETAILED SPECIFICATION OF THE INVENTION

With reference to FIG. 1, a vacuum pump is diagrammatically shown to comprise a screw-rotor pump 2 in integration with at least one ejector 1. For example, the ejector 1 may be a multi stage ejector operated by compressed air from a high pressure source P, via the line 3. While expanded through the ejector's nozzles, the compressed air or other drive-gas generates a sub-pressure that causes flap valves in the ejector ports to open and communicate with an evacuation chamber V, via a line 4. The drive-gas and the evacuated gas or air is discharged from the ejector mouth as illustrated by an arrow p.

Starting from a predetermined pressure level below atmosphere, the screw-rotor pump 2 is arranged to operate in parallel with the ejector 1. To this purpose, an electrically operated compressed-air valve 5 is arranged to supply drive-gas to the screw-rotor pump via a line 6 as the pressure in the evacuated chamber V is reduced to a predetermined lower level, such as about 300 mbar as reduced from an atmosphere pressure of about 1000 mbar. An electrically or vacuum operated valve, or a non-return valve, may be operated concurrently to shut off the direct communication via line 4 between the ejector and the evacuated chamber V. A vacuum relay, not shown in FIG. 1, is advantageously arranged to monitor the pressure in the evacuated chamber V in order to control the valve/valves.

The screw-rotor pump 2 comprises an expansion section 7 having intermeshing rotors, driven for rotation by the expanding drive-gas. The expansion section 7 drives a compression section 8 having intermeshing rotors, communicating with the evacuated chamber V through an inlet opening 9, and communicating with the ejector 1 via a discharge opening 10. The discharge from the screw-rotor's expansion section 7 communicates with the ejector mouth via a line 11. Line 11 opens downstream from the ejector mouth in order to introduce the expanded drive-gas from the screw-rotor pump into the discharge flow from the ejector. This way, expanded drive-gas of lower temperature is mixed with the discharged gas from the ejector, the later comprising the compressed gas of elevated temperature from the screw-rotor pump.

FIG. 2 diagrammatically illustrates an embodiment example, suggesting a realization of the arrangement of FIG. 1 by the integration of a screw-rotor pump and an ejector in a common pump structure. Structure details are omitted from the drawing for reasons of clarity.

The vacuum pump 100 comprises a vacuum port V arranged for connection to a vacuum operated process, an inlet opening 101 for drive-gas, and an outlet opening 102 for drive-gas and evacuated gas. In this embodiment, the ejector 103 is illustrated as a multi stage ejector having nozzles 104 arranged in series, and ports 105 communicating with the vacuum port V through a passage 106. The flow connection through passage 106 is controlled by a non-return valve, or by a vacuum controlled or electrically controlled valve 107 of the NO type (normally open). The ejector, which may be of a type that is formed with a rotationally symmetric body having ports 105 and flap valves 108 integrated in the cylindrical wall of the ejector, mouths on the inner side of a muffler 109.

A screw-rotor pump incorporated in the pump 100 comprises an expansion section 110 and a compression section 111. The expansion section has intermeshing, male and female rotor bodies that are operatively connected via shafts 112 to corresponding rotor bodies of the compression section, in order to transfer rotational movements between the rotor bodies. For a comprehensive description of the structure and operation of a screw-rotor pump, reference is made to the literature since screw-rotor pumps per se are conventional and the further specification refers to the distinguishing technical features of the present invention.

The expansion section 1 10 has an inlet 113 for drive-gas, supplied via the drive-gas inlet 101 as a result from opening an electrically controlled compressed air valve 114 of the NC type (normally closed). The discharge outlet 115 of the expansion section communicates with the pump discharge 102 via a conduit 116, mouthing downstream of the ejector's mouth. The compression section 111 communicates with the vacuum port V through an inlet 117 for drawing gas evacuated from the vacuum port, and communicates with the ejector 103 through an outlet 118 for discharge of compressed gas. Though merely indicated in the drawing, the rotor bodies of the screw-rotor pump are supported for rotation in the pump body for a gas tight and friction reduced rotation at adequate rotation speeds.

The operation of the vacuum pump 100 will now be explained. Drive-gas, air in general, is supplied through the ejector 103 causing the ejector ports 105 to open in result of the pressure drop generated between the ejector nozzles, and gas is drawn towards the ejector from the vacuum port V as known per se. Upon reaching down to a predetermined sub-pressure level, for example 300 mnbar, which is monitored and detected by means of a vacuum relay or the pressure operated valve 107, the valve 114 opens for directing drive-gas via the inlet 113 to the expansion section 110 of the screw-rotor pump. The expanding drive-gas forces the rotor bodies of the expansion section to rotate, and the expanded drive-gas is expelled via the discharge outlet 115 and conduit 116 to the ejector discharge 102, downstream of the ejector mouth. The expanded drive-gas, expelled from the expansion section, has a low relative temperature typically in the order of 10° C. or less.

The expansion section 110 operates like a motor, the rotation of which is transferred via shafts 112 to the compression section 111 of the screw-rotor pump. Gas is thus drawn into the compression section from the vacuum port V, via the inlet 117, where it is compressed and discharged to the ejector via the outlet 118 from the compression section. The compressed gas has an elevated temperature, typically in the order of 60° C., or even more if the pressure at the vacuum port is reduced down to about 5 mbar, e.g. The hot, compressed gas is drawn into the ejector to be mixed with the drive-gas forced through the ejector, and further to be mixed with the expanded drive-gas from the expansion section of the screw-rotor pump, downstream of the ejector mouth. This way, the gas or air that is expelled via the discharge outlet 102 has reached a normal room temperature, or even lower, upon discharge.

The vacuum pump 100 is characterized by a fast initial effect within an upper pressure region below atmosphere, and a high efficiency within a lower pressure region down to very low pressures or vacuum. These operational advantages are provided through the integration of an ejector and a screw-rotor pump. According to the invention, the efficiency is further enhanced by an integration by which the screw-rotor pump operates via the ejector. Through an extensive use of the drive-gas for cooling the compressed gas leaving the screw-rotor pump, the pump of the present invention may be implemented in de-centralized vacuum systems and also in applications where temperature is critical, and wherein lowest possible pressure is desired.

The present invention may be realized in embodiments different from the above. For example, several ejectors may be interconnected to be driven in parallel from one and same drive-gas source. In applications where temperature is less critical, the drive-gas from the screw-rotor pump may be separately discharged from the expansion section. Another modification may foresee that the expanded drive-gas is circulated via conduits from the expansion section for cooling the compression section, or its outlet. In place of a pressure controlled valve, the communication between the vacuum port and the ejector may include an automatic non-return valve, and a vacuum relay be arranged to generate a signal that activates the valve in the inlet to the expansion section. All these and other modifications, rendered obvious to a man skilled in the art from reading this specification, have been foreseen and included in the invention as claimed.

The invention claimed is:

1. A vacuum pump comprising a screw-rotor pump having a compression section (8) and an expansion section (7), characterized in that a discharge (10) from the compression section communicates with at least one ejector (1) for discharge of compressed gas through the ejector, wherein the expansion section (7) is connectable, via a first valve means (5), to a drive-gas source (P) for operating the screw-rotor pump and the ejector in parallel, and wherein a second valve means is arranged to close an evacuation passage (4) to the ejector, when said first valve means is open for driving the screw-rotor pump.

2. The vacuum pump of claim 1, wherein the valve (5) is arranged to connect the screw-rotor pump (7,8) to the same drive-gas source that operates the ejector (1), and the first valve means (5) is opened for driving the screw-rotor pump in response to a sub-pressure generated by the ejector.

3. The vacuum pump of claim 1, wherein the expansion section (7) of the screw-rotor pump communicates (11) with a discharge (102) of the ejector in order to mix the discharge gases from the ejector with drive-gas which is expanded through the screw-rotor pump.

4. The vacuum pump according to claim 1, wherein the ejector is a multi stage ejector.

5. The vacuum pump according to claim 1, wherein the screw-rotor pump and the ejector are integrally formed in a common pump body.

6. The vacuum pump according to claim 1, wherein the first valve means (5) for directing drive-gas to the screw-rotor pump is an electrically controlled valve of the NC type, and the second valve means for closing the evacuation passage (4) to the ejector is an electrically controlled valve of NO type.

7. Method of providing sub-pressure to an industrial process, characterized in that at least one ejector (1) is used initially to reduce the pressure to a predetermined lower level, from where the pressure is further reduced by means of a screw-rotor pump (7,8) that is arranged to operate through, and in parallel with the ejector, wherein the screw-rotor pump and the ejector are driven from one and same drive-gas source (P), and the drive-gas is directed to the screw-rotor pump through a valve (15) in response to a subpressure generated by the ejector.

8. The method of claim 7, wherein the drive-gas for the screw-rotor pump is mixed with the discharge gas from the ejector for reducing the temperature in the discharge gases.

* * * * *